US009289104B2

(12) United States Patent
Justus

(10) Patent No.: US 9,289,104 B2
(45) Date of Patent: Mar. 22, 2016

(54) ADAPTER DEVICE FOR ATTACHING A VACUUM CLEANER BAG TO A RETAINING PLATE

(71) Applicant: Sovi GmbH, Hamburg (DE)

(72) Inventor: Michael Justus, Hamburg (DE)

(73) Assignee: Sovi GmbH, Hamburg (DE)

( * ) Notice: Subject to any disclaimer, the term of this patent is extended or adjusted under 35 U.S.C. 154(b) by 0 days.

(21) Appl. No.: 14/349,458

(22) PCT Filed: Oct. 5, 2012

(86) PCT No.: PCT/EP2012/069768

§ 371 (c)(1),
(2) Date: Apr. 3, 2014

(87) PCT Pub. No.: WO2013/050558

PCT Pub. Date: Apr. 11, 2013

(65) Prior Publication Data

US 2014/0245563 A1 Sep. 4, 2014

(30) Foreign Application Priority Data

Oct. 5, 2011 (EP) ..... 11184015

(51) Int. Cl.
*A47L 9/14* (2006.01)

(52) U.S. Cl.
CPC ..... *A47L 9/1436* (2013.01); *A47L 9/1427* (2013.01); *Y10T 29/49826* (2015.01)

(58) Field of Classification Search
CPC ..... A47L 9/1436; A47L 9/1683; A47L 9/127; A47L 9/1427; A47L 9/14; A47L 5/28
See application file for complete search history.

(56) References Cited

FOREIGN PATENT DOCUMENTS

| | | | |
|---|---|---|---|
| DE | 1175397 | B | 8/1964 |
| EP | 1932460 | A1 | 6/2008 |
| WO | 92/13479 | A1 | 8/1992 |

OTHER PUBLICATIONS

International Search Report and Written Opinion mailed Nov. 13, 2012 in corresponding PCT application No. PCT/EP2012/069768.
International Preliminary Report on Patentability mailed Apr. 17, 2014 in corresponding PCT application No. PCT/EP2012/069768.
European Search Report dated Mar. 19, 2012 in corresponding European patent application No. EP 11184015.3.

*Primary Examiner* — Dung Van Nguyen
(74) *Attorney, Agent, or Firm* — Nields, Lemack & Frame, LLC

(57) ABSTRACT

An adapter device for attaching a vacuum cleaner bag to a retaining plate intended to be received in a vacuum cleaner bag retaining device of a vacuum cleaner and comprising a retaining plate through hole is described. The adapter device has a base element comprising a first surface and a second surface as well as a through hole which extends between the first and the second surface. The clamping arrangement comprises at least one deformable clamping element which is attached or can be attached to the base element and can be brought into a first and a second deformation state.

13 Claims, 4 Drawing Sheets

ADAPTER DEVICE FOR ATTACHING A VACUUM CLEANER BAG TO A RETAINING PLATE

Figure 1:
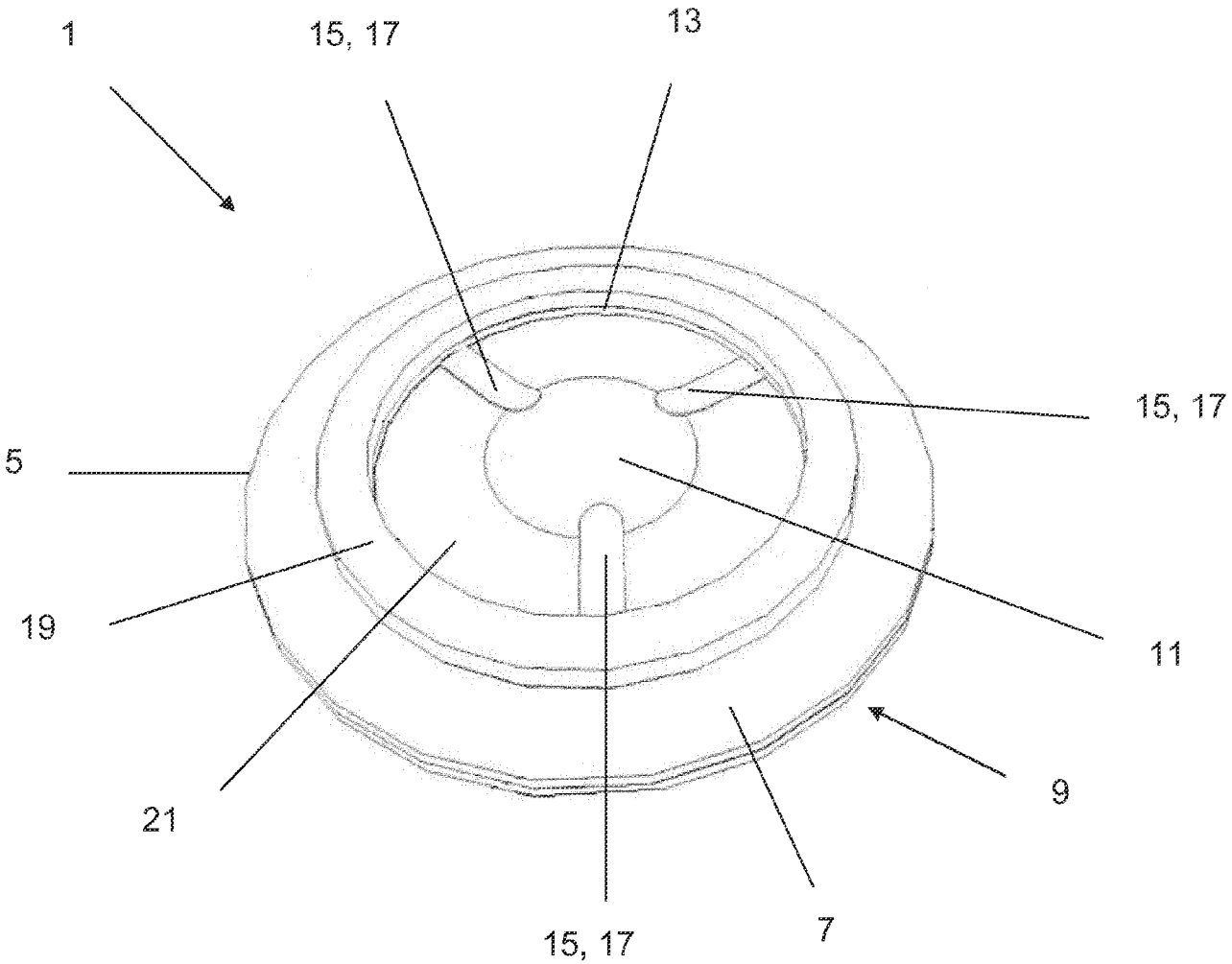

The present invention relates to an adapter device for the attachment of a vacuum cleaner bag to a vacuum cleaner specific retaining plate, which is supposed or destined to be received in a vacuum cleaner bag retaining device of a vacuum cleaner, which vacuum cleaner bag retaining device is adapted to this retaining plate, and comprises a retaining plate through hole, the adapter device having a base element, that comprises a first surface and a second surface as well as a through hole extending between the first and second surfaces. A further aspect of the present invention relates to a vacuum cleaner bag having a bag section, which is provided for storing dust and debris in the interior thereof and comprises an opening, and having a connecting section. A third aspect of the present invention relates to a method for connecting an adapter device for a vacuum cleaner bag to a vacuum cleaner specific retaining plate, which is supposed or destined to be received in a vacuum cleaner bag retaining device of a vacuum cleaner, which vacuum cleaner bag retaining device is adapted to this retaining plate.

In addition to a bag section provided with an opening vacuum cleaner bags typically comprise a retaining plate, which is provided with a retaining plate through bore or through hole and is attached or secured to the bag section in such a manner that the retaining plate through hole is disposed overlapping the opening of the bag section and the retaining plate through hole constitutes the access to the interior of the bag section. In other words, the retaining plate through hole is the inflow opening of the vacuum cleaner bag. The edge region of the retaining plate is partially or completely spaced from the actual bag, so that the retaining plate can be inserted into a suitably shaped vacuum cleaner bag retaining device of a vacuum cleaner and can be releasably mounted or secured therein in a predetermined position by suitable means of the vacuum cleaner bag retaining device engaging the retaining plate and in particular the edge region thereof which is spaced from the bag section. For example, such a vacuum cleaner bag retaining device can comprise a rail or track means, into which the retaining plate can be inserted. The retaining plates are typically planar, i.e. not curved.

In this connection every manufacturer of vacuum cleaners and vacuum cleaner bags as a rule provides that the vacuum cleaner bags of other manufacturers cannot be used with the own vacuum cleaners, and moreover often also that not all own vacuum cleaner models are usable with the same type of vacuum cleaner bag. Rather, the user of a vacuum cleaner must always buy vacuum cleaner bags of the type corresponding to or matching the manufacturer and model of the respective vacuum cleaner. In order to accomplish that the vacuum cleaner bags are device or model specific in this manner, on the one hand vacuum cleaner bags of different types are provided with different retaining plates, which differ, for example, in their dimensions, shapes and/or positions and dimensions of the retaining plate through holes forming the inflow opening, and on the other hand in the respectively associated vacuum cleaners the vacuum cleaner bag retaining device is constructed in such a manner that essentially only the corresponding retaining plate can be mounted therein in the predetermined position. Thus, very many vacuum cleaners differ in the configuration of the vacuum cleaner bag retaining device, whereby a distinct form of vacuum cleaner bag is required for each of these different vacuum cleaners or vacuum cleaner bag retaining devices. In other words, the retaining plates of conventional vacuum cleaner bags are in each case specifically developed, designed or formed for a particular vacuum cleaner model or a particular vacuum cleaner model group, in particular by different vacuum cleaner models having differently shaped or designed mountings for the retaining plates and often also by the position and the diameter of the inflow opening in the respective retaining plates being different. Thus, such retaining plates are vacuum cleaner specific retaining plates. They are attached to the device specific vacuum cleaner bag provided by the manufacturer and are constructed such that they fit into a device specific retaining device provided in the vacuum cleaner.

The necessitation of having to use device or vacuum cleaner specific vacuum cleaner bags is disadvantageous not only for the consumers, who tediously have to select among a plurality of different vacuum cleaner bags the respective matching one for their vacuum cleaner and have to find a retailer carrying it, but also for retailers who must keep in stock and offer a very large number of different vacuum cleaner bags, if they want to address a large range of customers.

From the prior art solutions are known that circumvent the problem of the necessity of vacuum cleaner bags specifically adapted to the respective vacuum cleaner model by providing an adapter device by means of which a universal vacuum cleaner bag—i.e. a vacuum cleaner bag having, including its retaining plate which is as a rule present, predetermined shapes and dimensions independent of a particular vacuum cleaner model—can be attached or secured to a vacuum cleaner specific retaining plate, which has been detached previously by the user from a corresponding vacuum cleaner specific vacuum cleaner bag. In this regard, it is known on the one hand to provide a universal vacuum cleaner bag having an own, universal retaining plate as well as a separate adapter device, which must be connected on the one hand to the retaining plate of the universal vacuum cleaner bag and on the other hand to the vacuum cleaner specific retaining plate. On the other hand it is also known to provide a universal vacuum cleaner bag having an own, universal retaining plate, which must be secured directly to the vacuum cleaner specific retaining plate by means of an adhesive connection, e.g. by adhesive tape or film. Within the scope of the present application such a retaining plate, which is fixedly connected to the bag section of a (universal) vacuum cleaner bag and, thus, forms an integral component of the latter, is also referred to as adapter device, because it must be adapted to enable its connection to different vacuum cleaner specific retaining plates.

Known adapter devices comprise a plate-shaped or also differently shaped base element having a first surface and a second surface as well as a through bore or through hole which extends between the first and second surfaces and, in use, constitutes a portion of the inflow opening into the vacuum cleaner bag. At its second surface the base element is either fixedly connected by suitable means to a bag section or can be releasably connected to a bag section by suitable means. In the case of a fixed connection the base element constitutes, in the connected state, the retaining plate or a part of the retaining plate of a vacuum cleaner bag constituted by the bag section and the retaining plate and being universal in the above sense. In other words, in the first case the combination of bag section and adapter element itself constitutes a universal vacuum cleaner bag, wherein the adapter element is the retaining plate of such a universal vacuum cleaner bag, and in the second case the adapter device can be connected to a universal vacuum cleaner bag, which has in turn a retaining plate having predetermined dimensions and shapes. For this purpose, a connecting section is then arranged at the second surface of the base element, by means of which connecting section the base element can be connected to the retaining plate of the universal vacuum cleaner bag. In any case, such a universal vacuum cleaner bag is characterized in that it—and in particular its retaining plate—always has the same, predetermined shapes and dimensions, independent of the vacuum cleaner in which it is to be utilized. In all cases mentioned, it is also possible to utilize a retaining element, which is not plate-shaped, instead of a retaining plate. The base element is further destined or intended to be connected in the manner already mentioned at its first surface to a retaining plate specifically adapted to a particular vacuum cleaner or the vacuum cleaner retaining device thereof. In any case, the combination of a universal vacuum cleaner bag of predetermined dimensions and shapes provided with such an adapter device and a vacuum cleaner specific retaining plate can be mounted, by means of the vacuum cleaner specific retaining plate, like a regular vacuum cleaner specific vacuum cleaner bag on the vacuum cleaner bag retaining device adapted to the vacuum cleaner specific retaining plate.

Until now, the connection between the adapter device or the first surface of the base element of the adapter device—or the retaining plate of a universal vacuum cleaner bag, which retaining plate then itself is to be regarded as adapter device—and a vacuum cleaner specific retaining plate has been established by means of an adhesive connection, wherein in the adhesively bonded state the through hole of the adapter device at least partially overlaps the retaining plate through hole and, thus, the suction air flow can flow through the adapter device at the through hole.

However, it has been found that such an adhesive connection does not guarantee—as would be required in accordance with the sense and purpose of the adapter device—a reliable connection, which is permanently stable, on different and, ideally all, retaining plates of commercially available vacuum cleaner bags. This pertains to, for example, particular materials which are often used for retaining plates, such as, e.g., polyethylene or polypropylene. Prior to a more or less reliable adhesive bonding, corresponding low-energy plastic materials require a special, effortful surface treatment, which constitutes a disadvantageous effort for a user. Especially in the case of such materials without sufficient pre-treatment, but also generally there is the great danger that the adapter device—promoted by the heat and vibrations generated during operation in the vacuum cleaner—detaches from the retaining plate. As a result, the adapter device becomes unusable, and dust and debris finds its way into the interior of the vacuum cleaner. Moreover, in any case the use of high-quality plastic materials desirable for a reliable connection entails such high costs that the adapter device becomes uneconomical.

For the stated reasons universal vacuum cleaner bags and corresponding adapter devices have not gained broad acceptance in the market until now. Therefore, when needing a new vacuum cleaner bag the consumer as a rule still has to check which type of vacuum cleaner bag is the correct one for his or her respective vacuum cleaner, and then has to find and select the same at a retailer among many others.

It is an object of the present invention to provide an adapter device for attaching or securing a vacuum cleaner bag to a retaining plate, which is supposed to be received in a vacuum cleaner bag retaining device of a vacuum cleaner and comprises a retaining plate through bore or hole, by means of which adapter device a connection or coupling between the adapter device and different retaining plates of different materials, which connection or coupling is also reliable and stable during operation of the vacuum cleaner, can be established in a simple manner and the problems of the prior art mentioned are avoided.

This object is achieved by an adapted device having the features of claim 1, a vacuum cleaner bag having the features of claim 13, and a method having the features of claim 15. Advantageous embodiments of the adapter device, the vacuum cleaner bag and the method are the subject-matter of the respective associated dependent claims.

According to the present invention an adapter device for attaching or securing a vacuum cleaner bag to a retaining plate is provided, which retaining plate is supposed or destined to be received in a vacuum cleaner bag retaining device of a vacuum cleaner, comprises a retaining plate through bore, through hole or through opening—constituting the inflow opening in use—and preferably is not curved. For this vacuum cleaner specific retaining plate and the general operating principle and mode of operation of the adapter device the above explanations apply. Thus, the adapter device in particular also comprises a base element that comprises a first—preferably planar—surface and a second—also preferably planar—surface as well as a through bore, through hole or through opening extending between the first surface and the second surface. The through hole can also be designated as inflow opening because in use the dust flows through it into the interior of the vacuum cleaner bag. The first and second surfaces are each a segment or partial portion of the total surface of the base element, wherein—as will be explained later-on—in use the first surface is preferably located on the side facing away from the vacuum cleaner bag or is formed by that side, and in use the second surface is preferably located on the side facing the vacuum cleaner bag or is formed by that side.

As has already been explained above and as will become clear in the following, the through hole is supposed or provided to be arranged in partially or completely overlapping alignment or orientation and preferably in centered alignment or orientation with the retaining plate through hole of a retaining plate, which is being attached or secured to the adapter device, wherein in use in the vacuum cleaner they form together the in-flow opening of the vacuum cleaner bag, through which the dust enters the interior of the vacuum cleaner bag from the pipe of the vacuum cleaner.

The adapter device further comprises a clamping arrangement, or clamping means or apparatus, which in turn comprises at least one deformable or flexible clamping element, which can be attached or preferably is attached to the base element and can be brought into a first and a second deformation state. As will become apparent from the description of the mode of operation, the term of the second deformation state can encompass different actual deformation states or shapes of the at least one clamping element, which are present depending on the actual construction or design of the vacuum cleaner specific retaining plate. One could then instead also refer to at least one second deformation state.

The at least one clamping element and the base element are constructed and designed such that it is possible, after the at least one clamping element—and in the case of multiple clamping elements each of these clamping elements—has been brought into the first deformation state, to place a vacuum cleaner specific retaining plate of the above-described type, i.e. a retaining plate being provided with a retaining plate through hole connecting the extended opposite surfaces of the retaining plate, on the first surface of the base element in such a manner that the retaining plate engages or bears against the first surface of the base element and the through hole of the base element is arranged to completely or at least partially overlap the retaining plate through hole, and can be removed again from the first surface. In the case of clamping elements, which can be attached to the base element and removed again therefrom, this encompasses the possibility that the at least one clamping element is removed from the base element after it has been brought into the first deformation state, subsequently the retaining plate is put in place, and finally the clamping element—after it has been at first brought again, where applicable, into its first deformation state—is attached again to the base element by arranging it on the base element and bringing it into the second deformation state or a second deformation state.

The at least one clamping element and the base element are further constructed in such a manner that in its or a second deformation state the at least one clamping element—in the condition attached to the base element—engages the surface of a retaining plate placed on in the manner described, which surface faces away from the base element, and clampingly retains the retaining plate on the base element. In other words, the retaining plate is clamped between the base element and the at least one clamping element by the clamping element and the base element engaging the opposite surfaces of the vacuum cleaner specific retaining plate.

In this regard it is possible that the at least one clamping element and the base element are constructed in such a manner that the described arrangement of a vacuum cleaner specific retaining plate on the base element, after the at least one first clamping element has been brought into the first deformation state, and the described subsequent clamping of the retaining plate to the base element by bringing the at least one clamping element into the second deformation state is possible at least for vacuum cleaner specific retaining plates, in which the retaining plate through hole has a diameter or radius from a—preferably predetermined—diameter or radius range and the thickness of which, in particular at the edge or border of the retaining plate through hole, lies in a—preferably predetermined—thickness range, or in which the value of a function of the diameter or radius and the thickness, e.g. the sum of the difference of thickness and radius and of a constant, lies in a—preferably predetermined—range or does not exceed a maximum value. However, it is preferred if arbitrary vacuum cleaner specific retaining plates of the mentioned type can be utilized.

It has been found surprisingly that by means of such clamping elements it is possible to establish in a simple manner a sufficiently secure connection or coupling between an adapter device for a vacuum cleaner bag and a vacuum cleaner specific retaining plate. In this regard, it is possible without difficulty to precisely and specifically arrange and locate or fix the through hole of the base element with respect to the retaining plate through hole, which is differently arranged and dimensioned from retaining plate to retaining plate, and it is possible to utilize vacuum cleaner specific retaining plates having differently shaped and dimensioned retaining plate through holes. Furthermore, the clamping connection is advantageously releasable again quickly, without the adapter device or the retaining plate getting damaged or possibly becoming unusable. In particular, different from the case of an adhesive connection the surface of the vacuum cleaner specific retaining plate is not affected or attacked. Therefore, the adapter device is reusable when the vacuum cleaner specific retaining plate connected to it must be replaced, e.g. in the case of another damage of the vacuum cleaner specific retaining plate or a change of the vacuum cleaner model.

As has already been explained above, within the scope of the present application a (vacuum cleaner specific) retaining plate is understood as the plate, which is as a rule made of plastic material or paperboard or cardboard, which is secured at the opening of a vacuum cleaner bag and through which the inflow opening of the vacuum cleaner bag—the so-called retaining plate through hole—extends, and which is releasably connectable at the vacuum cleaner bag retaining device to the vacuum cleaner in such a manner that one end of the vacuum cleaner pipe or tube engages with the retaining plate through hole and, thus, the opening of the vacuum cleaner bag. In order to connect a vacuum cleaner specific retaining plate to the adapter device according to the invention, the retaining plate first must be separated and, e.g., torn away from a vacuum cleaner bag matching or corresponding to the respective vacuum cleaner. Following connection of the retaining plate to an adapter device according to the invention it is then possible in the manner also already explained above to also use any vacuum cleaner bag, which is connectable to the adapter device or of which the adapter device constitutes an integral component by being fixedly connected to a corresponding bag section, with this particular vacuum cleaner. In this manner a universal vacuum cleaner bag can be provided in an advantageous manner.

Thus, by means of the present invention an adapter device is provided in an advantageous manner, which can be easily and reliably attached or secured to vacuum cleaner specific retaining plates, after these have been separated from their vacuum cleaner bags, and in this manner the present invention enables utilizing a vacuum cleaner bag which can be utilized independent of the respective vacuum cleaner model and brand in all vacuum cleaners.

In a preferred embodiment the base element is plate-shaped or constructed as a plate, wherein the first and second surfaces are constituted by the two extended surfaces of the plate-shaped base element. Then, the base element can also be designated as base plate. In this regard, the plate preferably has a round or circular shape in order to minimize the risk of a collision of the base element during insertion into the vacuum cleaner bag receiving space of a vacuum cleaner and during securing or attaching a vacuum cleaner specific retaining plate, which is connected to the adapter device, to the vacuum cleaner bag retaining device of the vacuum cleaner and to permit an arbitrary angular orientation of the base element, but may also be, for example, square, rectangular or polygonal. In any case, it is advantageous if the plate-shaped base element is as thin as possible in order to minimize in use in the vacuum cleaner possible baffle or deflecting surfaces or obstruction surfaces for the air which is sucked in, on which surfaces dust may deposit on prior to reaching the interior of the vacuum cleaner bag. The through hole is preferably located at the center of the base element.

In case the base element is not designed to be plate-shaped, it is, however, also conceivable that the first and second surfaces do not extend parallel with respect to each other.

The through hole preferably has a round and more preferably a circular cross-section, because retaining plate through holes, i.e. retaining plate inflow openings, typically have such a cross-section. Further, the through hole is preferably dimensioned such that its diameter is larger than the diameter of retaining plate through holes of vacuum cleaner specific retaining plates, in order that the normal suction power of the vacuum cleaner is not reduced due to the use of the adapter device.

The base element is preferably made of plastic material, preferably by means of an injection molding process. However, cardboard or metal or combinations of the materials mentioned can also be used. Further, coatings may also be utilized.

In a preferred embodiment the at least one deformable clamping element is constructed and designed such that it is or can be attached to the base element and preferably to the edge or near the edge of the through hole in such a manner that in the second deformation state it extends from the base element or from the edge of the through hole through the retaining plate through hole of a retaining plate—and, depending on the attachment location, possibly also through the through hole of the base element—, which retaining plate—as described above—was placed on the first surface of the base element after bringing the at least one clamping element into the first deformation state. In other words, through the retaining plate through hole—and possibly also through the through hole of the base element—the at least one clamping element engages the surface of the retaining plate facing away from the base element. In this regard, it preferably projects from the edge of the through hole. It is expressly noted that the attachment itself of the at least one clamping element can be provided remote from the edge of the through hole and that the at least one clamping element then extends at first towards the edge and eventually, in the manner described, from the base element or from the edge of the through hole through the retaining plate through hole of a retaining plate.

It is preferred that at least two deformable clamping elements are provided, each of which having the described construction and operating principle and mode of operation. It is particularly preferred if the clamping arrangement, means or apparatus comprises two to four and in particular three clamping elements and particularly preferred four. Already with three or four clamping elements a precise positioning and reliable location of the through hole with respect to the retaining plate through hole of a retaining plate is possible in a simple manner. Further, it has been found that it is advantageously possible with four clamping elements, which are preferably uniformly spaced from each other in the circumferential direction of the edge of the through hole, to force sealing material, which is commonly provided on vacuum cleaner specific retaining plates and projects inwardly from the edge of the retaining plate through hole, outwardly towards the edge in order to avoid an adverse effect on the suction power. However, depending on the material of the base element as well as the strength of the clamping elements less clamping elements may also be sufficient, or more clamping elements may be required.

It is to be noted that it is also possible that in addition to a deformable clamping element or multiple deformable clamping elements of the described type at least one rigid clamping element is present, which is attached to the base element and is able to retain the retaining plate on the base element in cooperation with the at least one deformable clamping element. Such a rigid clamping element, which may be constructed and designed, for example, to be hook-shaped, then comprises an engagement section into which the retaining plate can be inserted for engagement, while the at least one clamping element is in the first deformation state or removed from the base element. The at least one deformable clamping element then can be brought—as the case may be after arrangement on the base element—from the first deformation state into the second deformation state, whereby it engages the retaining plate and clampingly retains the retaining plate in abutment with the first surface of the base element and thereby also prevent the rigid clamping element from disengaging from the retaining plate. Such rigid clamping elements are able to provide for an additional fixing or location, but have the disadvantage that it is difficult to allow for differently dimensioned retaining plates.

In a preferred embodiment, in which at least two deformable clamping elements are present which—as described above—are or can be attached to the base element and, for example, at the edge or near the edge of the through hole in such a manner that in the second deformation state they extend from the base element or from the edge of the through hole through the retaining plate through hole of a vacuum cleaner specific retaining plate, the at least two clamping elements are attached to the base element in such a manner or can be attached to the base element in such a manner that they are uniformly spaced from each other in the circumferential direction of the through hole of the base element. Thereby a uniform clamping or retaining force can be provided along the circumferential direction of the through hole, and an unintentional detachment of the base element from the retaining plate and an undesired relative displacement of the base element are impeded further.

The at least one deformable clamping element can be designed to be elastically deformable or resilient, wherein in the first deformation state it is biased towards the second deformation state. In other words, such a clamping element applies a progressively increasing elastic force when it is brought from the second into the first deformation state, and in use this restoring force causes the clamping force acting on the retaining plate. An elastically deformable clamping element can be provided in the form of a resilient clamp and either can be fixedly secured to the base element or can be separate from the base element and be attached to the base element upon the movement into the second deformation state only.

However, it is preferred that at least one of the at least one clamping element and preferably each of the at least one clamping element is plastically deformable or plastically bendable between the first and the second deformation state. As such a plastically deformable or plastically bendable clamping element, an elongate element can be utilized in an advantageous manner, which is designed, e.g., in the form of a strip or a tab or plate element as in the case of a file folder having a prong fastener and is plastically bendable or plastically deformable along its length. The elongate element may have, e.g., a round, rectangular, square or polygonal cross-section. However, it is preferred that the elongate element is designed to be flat. Plastically deformable or bendable clamping elements have the advantage that a bending force has to be applied during the movement between the first and the second deformation state only. Once the first or second deformation state is reached, however, the clamping element stably remains in this state without further forces having to be applied. Therefore, they are simpler to operate for the user than elastic clamping elements. Furthermore, with plastically deformable clamping elements it is possible to ensure particularly easy and reliable the possibility of the attachment of differently shaped and dimensioned retaining plates.

If at least one plastically deformable or bendable clamping element is provided, it is further preferred if in the first deformation state the at least one plastically deformable clamping element at least partially extends from the edge of the through hole of the base element towards an axis of the through hole and in particular extends with at least a portion radially into the through hole.

In this connection it is to be noted that, in other words, structurally the invention also very generally relates to an adapter device for securing or attaching a vacuum cleaner bag to a vacuum cleaner specific retaining plate of the type described above, wherein the adapter device comprises a base element, which has a first—preferably planar—surface and a second—likewise preferably planar—surface as well as a through bore, through hole or through opening, as well as a clamping arrangement, or clamping means or apparatus, which in turn comprises at least one deformable or flexible clamping element, which can be attached or preferably is attached to the base element and can be brought into a first and a second deformation state, wherein the at least one clamping element is plastically deformable or plastically bendable, in the first deformation state extends at least partially from the edge of the through hole of the base element towards an axis of the through hole and, in particular, with at least a portion radially extends into the through hole, and upon bringing from the first into the second deformation state is partly bent in the axial direction extending from the second to the first surface and partly radially outwardly. In this regard, the base element and the clamping arrangement or means can comprise the structural configurations and constructions indicated above and in detail in the following. For example, the at least one clamping element may be constructed and designed as an elongate strip.

Independent of the configuration and construction the clamping elements can be made of different coated and uncoated materials, such as, for example, of wire, metal film or sheet, spring steel or sheet metal. A coating may be made of plastic.

In a preferred embodiment the first surface of the base element comprises a sealing layer surrounding the through hole. This sealing layer forms a portion of the first surface of the base element and is preferably arranged annularly closed and is preferably located in immediate proximity to the through hole. The sealing layer is preferably made of an elastically compressible material, such as, e.g., foamed plastic, silicone or a fleece material. Such a sealing layer has the advantage that following attachment of a retaining plate to the base element possible surface irregularities or unevenness of the retaining plate are compensated, and at the same time the suction flow channel formed by the through hole of the base element and the retaining plate through hole is sealed in the radial direction between retaining plate and base element, so that the vacuum cleaner does not draw leak air between these two components, whereby the suction effect would be reduced or dust and debris could possibly exit.

In an advantageous embodiment a sealing ring of flexible or elastic material is provided at the edge of the through hole, which sealing ring radially extends from the edge into the through hole. Such a sealing ring, which—as mentioned above—is typically also provided on vacuum cleaner specific retaining plates, has the task of sealing an existing gap between the edge of the through hole and the suction pipe connection of a vacuum cleaner. A suitable material for constructing the sealing ring is latex.

In a preferred embodiment a retaining arrangement or retaining means for retaining a connecting section of a vacuum cleaner bag section on the base element, which connecting section preferably has predetermined dimensions and shapes, is provided on the second surface. The retaining means may be constructed, e.g., such that a plug connection or slip joint, a snap connection, a hook connection or a flange connection is being or is established with the connecting section of the vacuum cleaner bag section. The retaining arrangement or retaining means may also comprise, e.g., a rail or track arrangement, into which the connecting section is being or is inserted, wherein in this case or in the other cases the connecting section can be constructed as a retaining plate or a differently shaped retaining element of a (universal) vacuum cleaner bag, which comprises the vacuum cleaner bag section and the connecting section or is formed by them. Preferably, such a (universal) retaining plate may be round or circular. The retaining arrangement or retaining means may retain the connecting section fixedly or releasably. In the former case, the retaining arrangement or retaining means may also be formed, for example, by adhesive, wherein the connecting section is, for example, simply a portion of the bag section in immediate proximity to the edge of the opening of the bag section. In the latter case it is preferred if the retaining means or arrangement and the connecting means or arrangement are constructed to be complementary with respect to each other in their dimensions and shapes, so that they can matchingly interengage each other. In this manner, any vacuum cleaner bag, the connecting section of which is or can be connected to the retaining means or arrangement of the adapter device, can be coupled by means of the adapter device to the vacuum cleaner, the matching vacuum cleaner specific retaining plate of which is currently connected to the adapter device. In any case, after connection between the retaining means or arrangement and the connecting section, the adapter device and the vacuum cleaner bag section, which in the case of a releasable attachment with its connecting section in the manner described above can also be regarded by itself as a universal vacuum cleaner bag, constitute a universal vacuum cleaner bag, which can be adapted to a particular vacuum cleaner by attachment of a vacuum cleaner specific retaining plate.

In a preferred embodiment the adapter device comprises a closure element that is hingedly or pivotably attached to the base element and can be pivoted into a closure state in which it closes and seals the through hole. In particular, such a closure element may preferably be constructed as closure flap. Then, in an advantageous manner the closure element can be brought into the closure state when a vacuum cleaner bag section connected to the adapter device is filled with dust and debris and is separated from the vacuum cleaner together with the adapter device for replacement, in order to prevent an escape of the dust and debris received in the interior of the vacuum cleaner bag. In this regard, the clamping elements are preferably constructed and arranged such that they can be brought into a third deformation state, in which they fix or secure the closure element in the closure state thereof, or that in their first deformation state they fix or secure the closure element in the closure state thereof. In this connection, in particular the plastically deformable elongate clamping elements mentioned above, e.g. in the form of strips or tabs, are advantageous.

In the manner already explained, the described adapter device advantageously can be part of a vacuum cleaner bag comprising a bag section, which is provided for storing dust and debris in the interior thereof and has an opening, and a connecting section, which is fixedly or releasably connected to the adapter device in such a manner that the through hole of the base element is aligned with the opening of the bag section. As in the case of conventional vacuum cleaner bags the bag section is preferably made of textile material. It is preferred that the adapter device is fixedly connected to the connecting section. The adapter device then constitutes an integral component of the vacuum cleaner bag and can be designated as its retaining plate or retaining element. In this case the at least one clamping element constitutes at least one adapter means, by means of which such a (universal) retaining plate or such a universal retaining element can be connected easily and reliably to a vacuum cleaner specific retaining plate.

In this connection it is to be noted that structurally a vacuum cleaner bag according to the invention can also be described very generally in that it comprises a bag section and an adapter device for attaching or securing the vacuum cleaner bag to a vacuum cleaner specific retaining plate of the type described above, which adapter device is connected to the bag section, wherein the adapter device comprises a base element, which comprises a first—preferably planar—surface and a second—likewise preferably planar—surface as well as a through hole, or through bore or through opening, as well as a clamping arrangement, or clamping means or apparatus, which in turn comprises at least one deformable or flexible clamping element which can be or preferably is attached to the base element and can be brought into a first and a second deformation state. It is then preferred if the at least one clamping element is plastically deformable or plastically bendable. Further, it is then preferred if in the first deformation state the at least one clamping element at least partially extends from the edge of the through hole of the base element towards an axis of the through hole and, in particular, with at least a portion radially into the through hole, and upon being brought from the first into the second deformation state is bent partly in the axial direction extending from the second to the first surface and partly radially outwardly. In this regard, the base element and the clamping arrangement may have the structural configurations indicated above and in detail in the following. For example, the at least one clamping element may be constructed and designed as elongate strip.

A further aspect of the present invention relates to a method of connecting an adapter device for a vacuum cleaner bag to a retaining plate, which is provided or supposed to be received in a vacuum cleaner bag retaining device of a vacuum cleaner.

In a first step of the method a vacuum cleaner specific retaining plate of the type already described is provided, which vacuum cleaner specific retaining plate is provided or supposed to be received in a vacuum cleaner bag retaining device of a vacuum cleaner and comprises a retaining plate through hole formed through the retaining plate. As has already been explained, such a retaining plate can be removed, e.g., from a vacuum cleaner bag matching or corresponding to the respective vacuum cleaner.

Further, an adapter device is provided, as has already been described in detail above, wherein the at least one clamping element is in the first deformation state or removed from the attachment or mounting element. Thus, the at least one clamping element does not yet engage the retaining plate, but permits placing the retaining plate on the first surface of the base element and away from the first surface of the base element.

Subsequently, the retaining plate is placed on the first surface of the base element in the manner likewise already explained in detail. When doing so, the through hole of the base element is aligned with the retaining plate through hole, wherein preferably a maximum overlap is established.

Finally, the at least one deformable clamping element is brought—as the case may be after arrangement on the base element—from the first deformation state into the second deformation state, wherein the at least one deformable clamping element engages the surface of the retaining plate facing away from the base element and clamps the retaining plate to the base element.

In the following, the present invention is explained in more detail on the basis of an exemplary embodiment with reference to the enclosed drawings.

Figure 2:
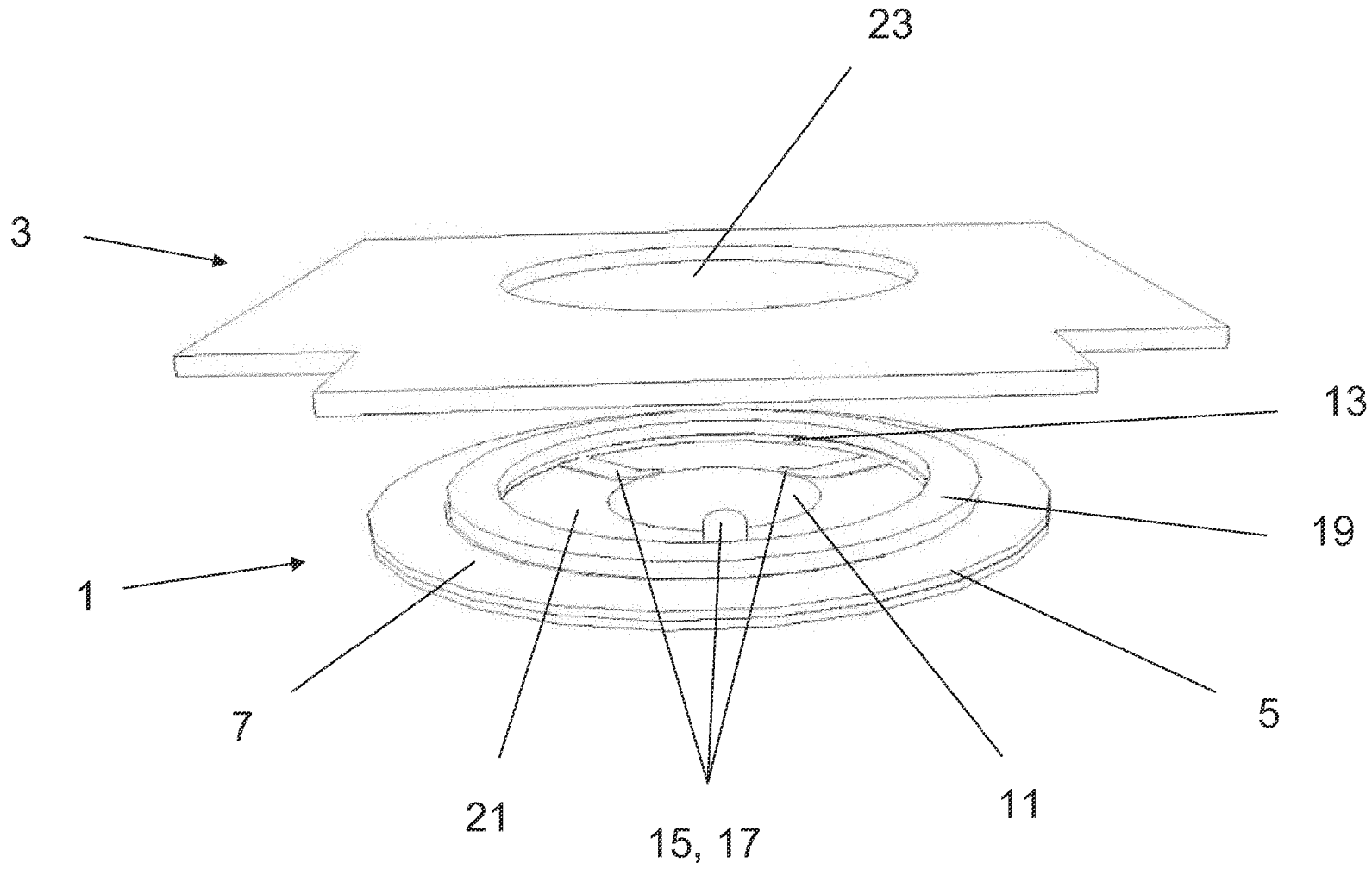
Figure 3:
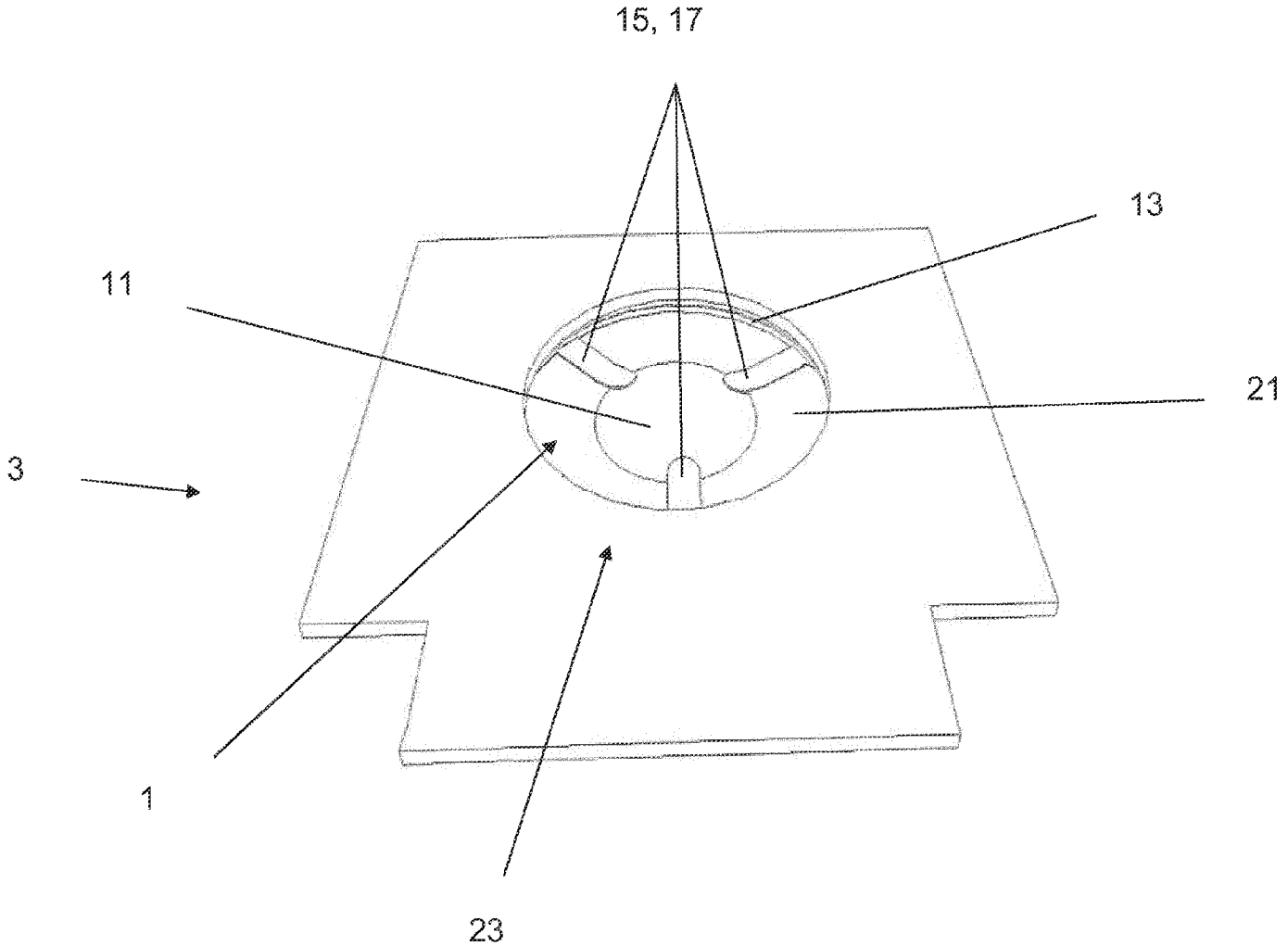
Figure 4:
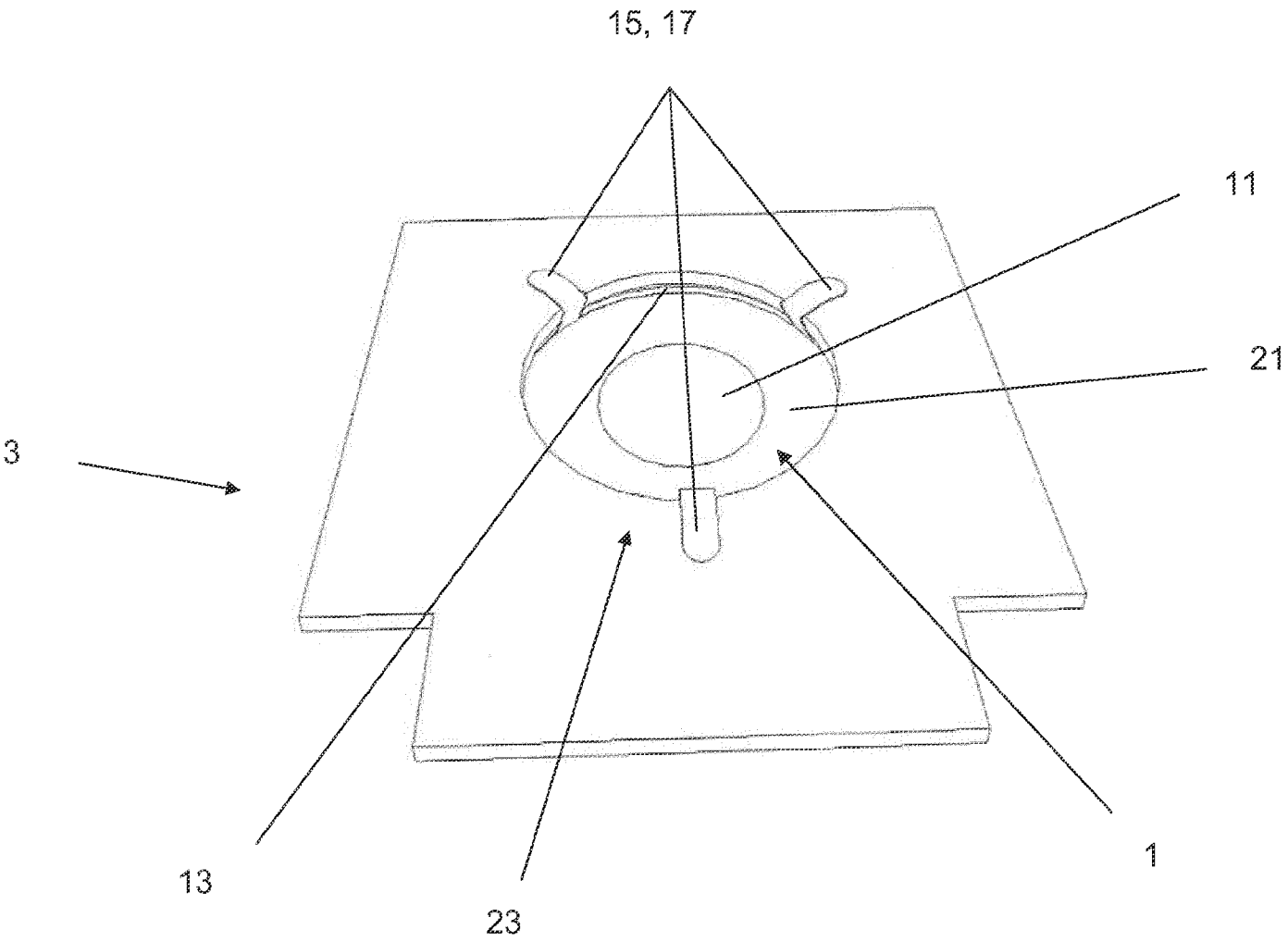

FIG. 1 is a perspective representation of an exemplary embodiment of an adapter device according to the invention having a round, plate-shaped base element and three uniformly spaced, plastically deformable clamping elements, FIG. 2 is the exemplary embodiment of FIG. 1 upon placing on a retaining plate, FIG. 3 is the exemplary embodiment of FIG. 1 after placing a retaining plate on it, wherein the deformable clamping elements are in the first deformation state, and FIG. 4 is the exemplary embodiment of FIG. 1 after placing a retaining plate on it, wherein the deformable clamping elements are in the first deformation state.

In FIG. 1 an exemplary embodiment of an adapter device 1 according to the invention for attaching or securing a vacuum cleaner bag to a retaining plate 3 is illustrated, which retaining plate 3 is intended to be received in a vacuum cleaner bag retaining device of a vacuum cleaner. The adapter device 1 comprises a plate-shaped, i.e. planar and flat, circular base element 5 made of plastic or cardboard and having a first surface 7 and a second surface 9. Centrally in the base element 5 a likewise circular through hole 11 is provided extending between the first and second surfaces 7, 9 in the thickness direction of the plate-shaped base element 5.

The through hole 11 is delimited by an edge 13 of the base element 5. At this edge 13 or in the region of this edge 13 a clamping arrangement 15 is secured to the base element 5, which clamping arrangement 15 comprises three plastically deformable clamping elements 17 which are uniformly spaced from each other. All three of these clamping elements 17 are flat, elongate and manually bendable tab or strip elements made of sheet metal, such as they are used, e.g., in file folders for fixing the stack of sheets. The clamping elements 17 extend in the radial direction from the edge 13 of the through hole 11 towards the center of the through hole 11.

The first surface 7 of the base element 5 further comprises a sealing layer 19 of elastic, airtight material, such as foamed plastic or fleece material, which is circular and annularly surrounds the through hole 11 in immediate proximity to the edge 13. In addition, a sealing ring 21 of flexible or elastic material, such as, for example, latex, is provided at the edge 13 of the through hole 11 on the side of the clamping elements 17 facing the second surface 9.

The adapter device 1 is either an integral or fixed component or part of a vacuum cleaner bag, by a bag section being fixedly attached to the second surface 9 of the base element 5 by a retaining arrangement or means which may also be adhesive, or can be connected to a connecting section of a vacuum cleaner bag by means of a suitable retaining arrangement or means on the second surface 9.

The adapter device 1 can be used in the following manner. In order to be connected to a retaining plate 3, which is intended to be received in a vacuum cleaner bag retaining device of a vacuum cleaner, the adapter device 1 is at first put with its first surface 7 against a retaining plate 3 provided with a retaining plate through hole 23 in such a manner that the through hole 11 of the base element 5 is aligned with the retaining plate through hole 23 (see FIG. 2). The retaining plate 3 may be obtained, e.g., by a preceding separation thereof from a vacuum cleaner bag intended or destined for the respective vacuum cleaner.

When putting the adapter device 1 against the retaining plate 5, the clamping elements 17 are in the first deformation state shown in FIGS. 1 to 3, wherein they radially extend from the edge 13 of the through hole 11 to the center of the through hole 11, so that they do not engage the retaining plate 3 and the retaining plate 3 can be freely moved away from the adapter device 1 (see FIG. 3). The adapter device 1 is moved so close to the retaining plate 3 until the sealing layer 19 is slightly compressed and in this manner seals the transition between the adapter device 1 and the retaining plate 3 in the radial direction.

For fixing the adapter device 1 on the retaining plate 3 in the position shown in FIGS. 3 and 4, the clamping elements 17 are brought from the first deformation state into the second deformation state, in which the clamping elements 17 extend at first in the radial direction away from the edge 13 of the through hole 11, through the retaining plate through hole 23 and to the surface of the retaining plate 3 facing away from the base element 5 and engage this surface of the retaining plate 3 and apply a force to it, in order to clamp the retaining plate 3 to the first surface 7 of the base element 5 (see FIG. 4).

Now, as the case may be, with the connecting arrangement or means (not shown) provided on the second surface 9 of the base element 5 the adapter device 1 can be connected to a connecting section, having predetermined dimensions and shapes, of a vacuum cleaner bag which is not specifically adapted to the vacuum cleaner in which it is to be utilized, and the retaining plate 3 can be received in the matching vacuum cleaner bag retaining device of a particular vacuum cleaner, whereby an arbitrary vacuum cleaner bag can be connected to a particular vacuum cleaner.

The invention claimed is:

1. An adapter device for attaching a vacuum cleaner bag to a retaining plate intended to be received in a vacuum cleaner bag retaining device of a vacuum cleaner and comprising a retaining plate through hole, which adapter device has a base element comprising a first surface and a second surface as well as a through hole which extends between the first and the second surface, and clamping arrangement comprising at least one deformable clamping element which is attached or can be attached to the base element and can be brought into a first and a second deformation state, wherein in the first deformation state of the at least one clamping element, the retaining plate of the vacuum cleaner bag, which retaining plate is provided with the retaining plate through hole connecting the extended opposite surfaces of the retaining plate to each other, can be placed on the first surface of the base element in such a manner that the retaining plate bears against the first surface of the base element and the through hole of the base element is arranged such that it at least partially overlaps the retaining plate through hole, and can be removed from the first surface, and in the second deformation state of the at least one clamping element, the at least one clamping element engages the surface of the retaining plate disposed in this manner, which surface faces away from the base element and retains the retaining plate on the base element, characterized in that at least one of the at least one clamping element is plastically deformable and comprises or is an elongate strip or an elongate tab element.

2. The adapter device according to claim 1, characterized in that the base element is constructed plate-shaped, wherein the first and the second surface are disposed opposite to one another and extend perpendicular to the thickness direction of the plate-shaped base element.

3. The adapter device according to claim 1, characterized in that the at least one deformable clamping element is or can be attached to the base element in such a manner that in the second deformation state it extends from the base element through the retaining plate through hole of the retaining plate, which has been placed on the first surface of the base element in the first deformation state of the at least one clamping element.

4. The adapter device according to claim 3, characterized in that at least two deformable clamping elements are provided, and the at least two clamping elements are attached or can be attached to the base element in such a manner that they are uniformly spaced from each other in the circumferential direction of the through hole of the base element.

5. The adapter device according to claim 1, characterized in that at least two deformable clamping elements are provided.

6. The adapter device according to claim 1, characterized in that at least one of the at least one clamping element is elastically deformable, wherein in the first deformation state the at least one elastically deformable clamping element is biased towards the second deformation state.

7. The adapter device according to claim 6, characterized in that the at least one elastically deformable clamping element is constructed as a clamp.

8. The adapter device according to claim 1, characterized in that in the first deformation state the at least one plastically deformable clamping element at least partially extends from the edge of the through hole of the base element towards an axis of the through hole.

9. The adapter device according to claim 1, characterized in that on its first surface the base element comprises a sealing layer surrounding the through hole.

10. The adapter device according to claim 1, characterized in that a retaining means for retaining a connecting section of a vacuum cleaner bag section on the base element is provided on the second surface.

11. A vacuum cleaner bag having a bag section, having a connecting section and having the adapter device according to claim 1, wherein the bag section is provided for storing dust and debris in the interior thereof and comprises an opening, characterized in that the connecting section is fixedly or releasably connected to the adapter device in such a manner that the through hole of the base element is aligned with the opening of the bag section.

12. The vacuum cleaner bag according to claim 11, wherein a retaining means for retaining the connecting section of the vacuum cleaner bag section on the base element is provided on the second surface and characterized in that the connecting section comprises predetermined dimensions and shapes and is releasably connected to the retaining means of the adapter device.

13. A method of connecting an adapter device for a vacuum cleaner bag to a retaining plate, which is intended to be received in a vacuum cleaner bag retaining device of a vacuum cleaner, comprising the following steps:

providing the retaining plate, which is specifically intended for receipt in the vacuum cleaner bag retaining device of the particular vacuum cleaner and which comprises a retaining plate through hole, providing an adapter device according to claim 1, wherein the clamping elements of the clamping arrangement are in the first deformation state, placing the adapter device on the retaining plate in such a manner that the through hole of the base element is aligned with the retaining plate through hole in an at least partially overlapping relationship, bringing the deformable clamping elements into the second deformation state in order to clampingly secure the retaining plate to the base element.

* * * * *